United States Patent [19]

Carr

[11] 3,997,304

[45] Dec. 14, 1976

[54] MOUNTING SYSTEM OF IONIZING WIRES OF ELECTROSTATIC PRECIPITATOR

[75] Inventor: Allan W. Carr, Seymour, Tenn.

[73] Assignee: Carrier Corporation, Syracuse, N.Y.

[22] Filed: Mar. 28, 1975

[21] Appl. No.: 563,016

[52] U.S. Cl. ..... 55/147; 55/132; 55/148; 55/138; 55/154; 55/139; 317/4

[51] Int. Cl.[2] ..... B03C 3/04

[58] Field of Search ..... 55/136–138, 55/146–148, 150, 154, 151, 152, 153, 132, 139; 317/4

[56] References Cited

UNITED STATES PATENTS

| | | | |
|---|---|---|---|
| 3,149,937 | 9/1964 | Revell | 55/147 |
| 3,707,828 | 1/1973 | Burney | 55/148 |
| 3,800,509 | 4/1974 | Carr et al. | 55/151 |

*Primary Examiner*—Bernard Nozick
*Attorney, Agent, or Firm*—J. Raymond Curtin; Barry E. Deutsch

[57] ABSTRACT

A mounting system for ionizing wires of electrostatic precipitation apparatus including a bus bar having a plurality of slots formed along the axial length thereof. A plurality of ionizing wires are spaced axially along the length of the bus bar and extend transversely thereto. At least one end of each of the ionizing wires is connected to a resilient spring. Each of the resilient springs are disposed in the slots formed in the bus bar. The springs function to transfer voltage from the bus bar to the ionizing wires and in addition function to maintain the ionizing wires under tension.

4 Claims, 1 Drawing Figure

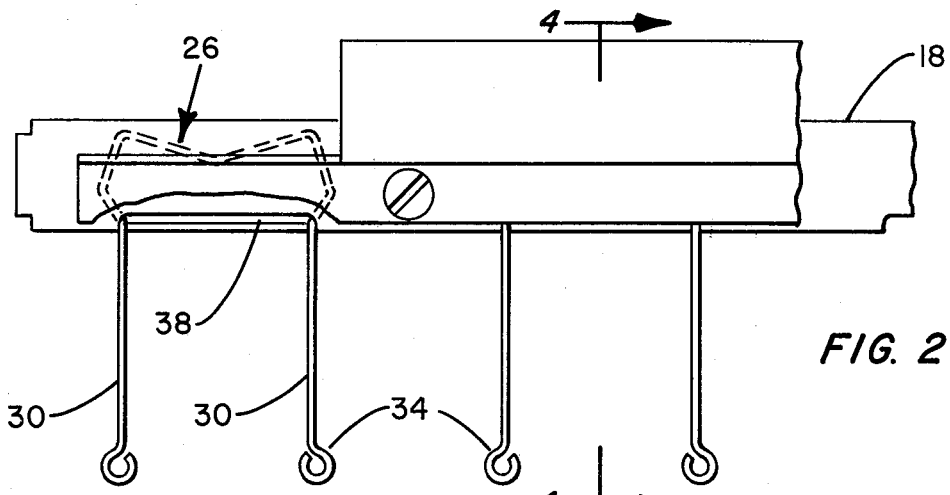
FIG. 2
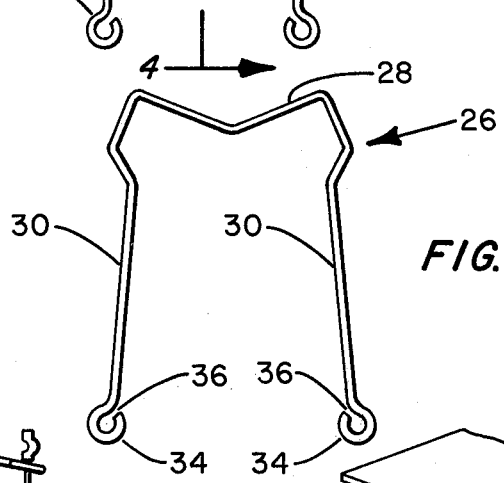
FIG. 6
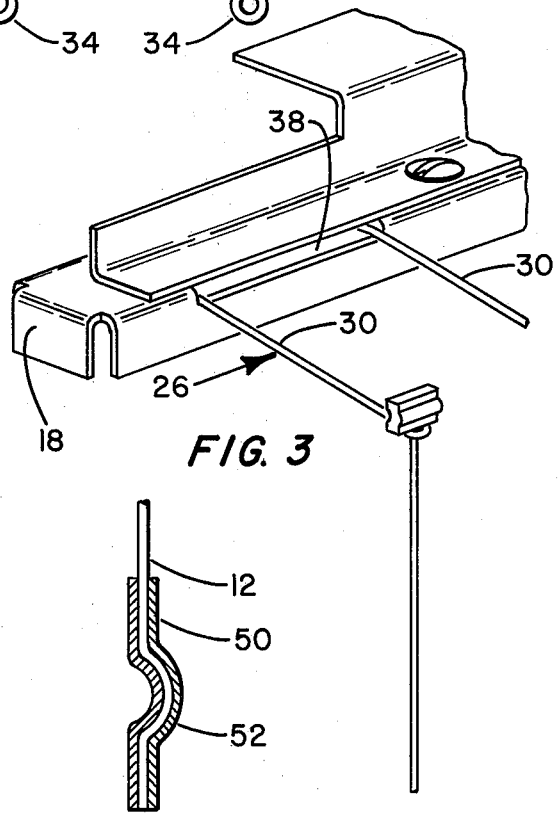
FIG. 3
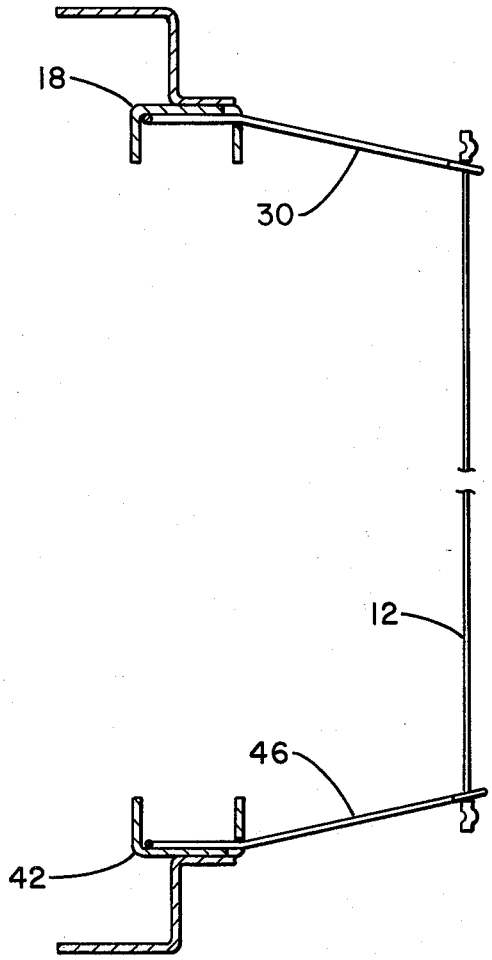
FIG. 4
FIG. 5

MOUNTING SYSTEM OF IONIZING WIRES OF ELECTROSTATIC PRECIPITATOR

BACKGROUND OF THE INVENTION

This invention relates to electrostatic precipitation apparatus, and in particular to a mounting system for the ionizing wires thereof.

As is known to those skilled in the art, electrostatic precipitation or air cleaning apparatus are generally installed as part of duct systems employed with forced air heating and/or cooling apparatus serving enclosures such as residences or the like. The apparatus generally includes a power pack which transforms conventional household AC voltage to a DC power source of substantial voltage. The increased DC voltage is applied to ionizer and collector sections of the apparatus for the purpose of creating electrostatic fields in the area traversed by the air stream flowing through the duct system. Generally, the ionizer section comprises a plurality of wires, each of which is disposed adjacent a plate so as to define a plurality of passages, each with an electrostatic field disposed therein. The electrostatic fields thus formed are of a magnitude that a corona discharge occurs from the wire. Particles of dirt or dust entrained in air flowing within the plurality of passages receive an electrical charge of a particular polarity to enable such dirt to be readily removed from the air stream at the collector section of the apparatus.

The ionizing wires are extremely fragile and sometimes break due to unusual vibrations or from other causes. Such broken ionizing wires must be replaced.

Very often, the mounting schemes for ionizing wires heretofore employed in electrostatic air cleaners of the prior art have been relatively complex and have made the replacement of any broken or otherwise inoperable ionizing wires a relatively complicated endeavor. Examples of mounting schemes of the prior art are disclosed in U.S. Pat. Nos. 2,380,993; 2,708,980; 2,867,286; 2,959,246; and 3,027,970.

Additionally, many of the mounting systems heretofore employed have included components terminating in sharp pointed elements. Such sharp pointed elements have a tendency to generate undesirable ozone.

Furthermore, it is extremely desirable that the ionizing wires be maintained under uniform tension to insure proper operation of the apparatus. Non-uniform tensioning of the wires might result in some of the wires either having slack in which case non-uniform electrostatic fields will be created; or in the alternative, excessive tension might cause the wires to break more readily.

SUMMARY OF THE INVENTION

Accordingly, it is an object of the invention to mount ionizing wires in an electrostatic air handling apparatus whereby the wire may be readily replaced.

It is a further object of this invention to mount the ionizing wires of electrostatic precipitation apparatus under uniform tension.

It is a further object of this invention to provide a mounting system for ionizing wires of electrostatic air cleaning apparatus of relatively simple design.

It is yet another object of the present invention to mount ionizing wires in a relatively simple yet efficient manner whereby undesirable ozone generation is eliminated.

These and other objects of the present invention are obtained in an electrostatic precipitation apparatus including a mounting system for the ionizing wires thereof. Bus bars are connected to a source of voltage for the apparatus. The bus bars include means defining a plurality of slots formed along the axial length thereof. The ionizing wires of the apparatus are spaced axially along the length of the bus bars and extend transversely thereto. A resilient spring is connected to at least one end of each of the ionizing wires, the resilient springs being disposed in the slots formed along the axial length of the bus bar. The springs transfer voltage from the bus bar to the ionizing wires and are further operable to maintain the ionizing wires under tension.

BRIEF DESCRIPTION OF THE DRAWINGS

FIG. 2 is a top plan view of the mounting system of the present invention;

FIG. 3 is a perspective view of a portion of the mounting system of the present invention;

FIG. 4 is a sectional view taken along lines IV—IV of FIG. 2;

FIG. 5 is a sectional view of a detail of the instant invention;

FIG. 6 is a plan view of a further detail of the instant invention; and

DESCRIPTION OF THE PREFERRED EMBODIMENTS

Figure 1:
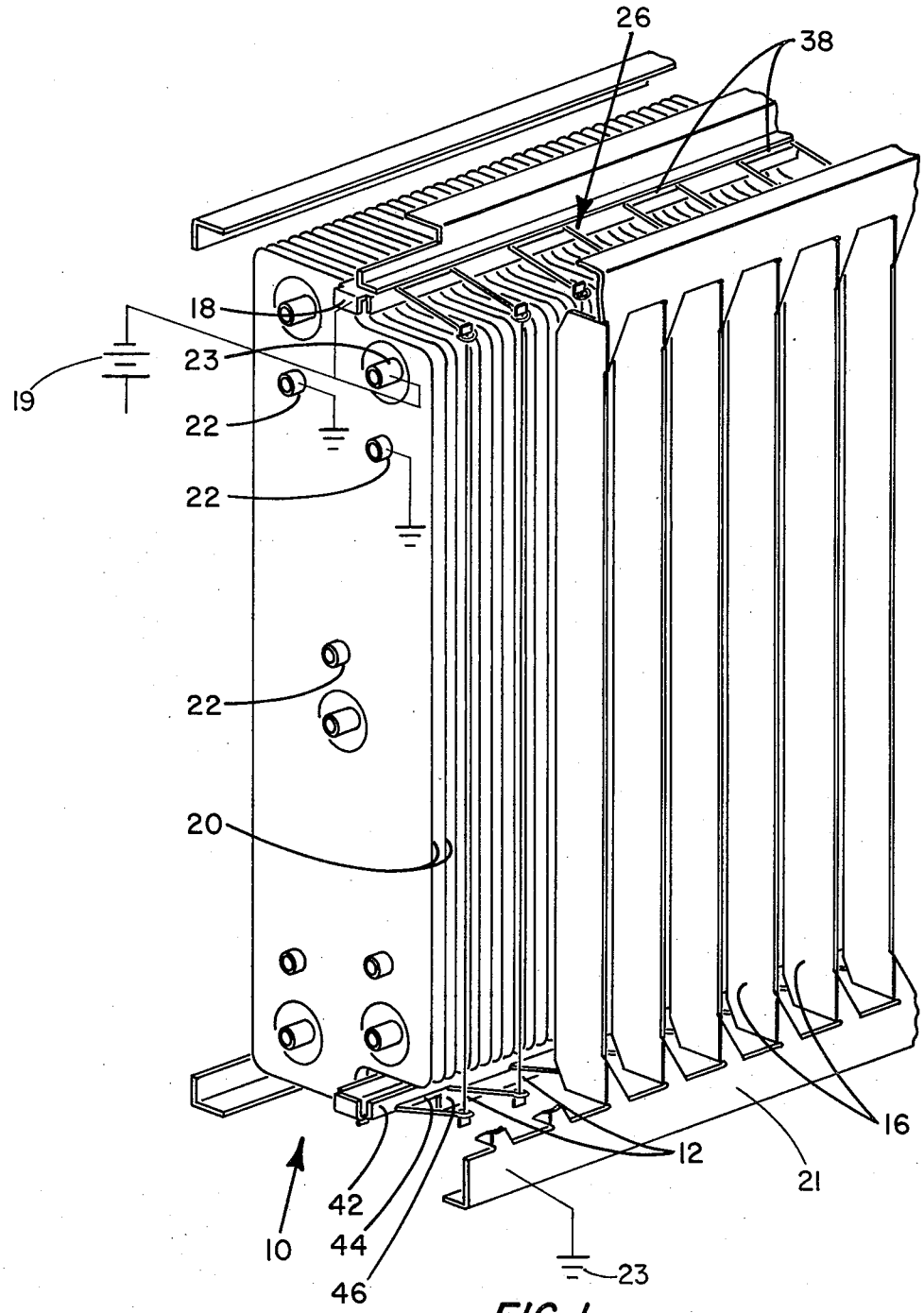
FIG. 1 is a perspective view of an electrostatic precipitation apparatus employing the mounting system of the instant invention.

Referring now to the drawings, there is shown a preferred form of mounting system in accordance with the present invention as used with various forms of electrostatic air cleaning apparatus. In referring to the various figures of the drawings, like numerals shall refer to like parts.

Referring particularly to FIG. 1, there is disclosed a first form of electrostatic air cleaning apparatus in which the present invention may be employed. As is known to those skilled in the art, electrostatic air cleaning apparatus include an ionizing section and a collecting section. In the ionizing section, air having foreign particles entrained therein is directed through electrostatic fields wherein the foreign particles obtain an electrostatic charge. Thereafter, the air stream including the charged foreign particles is directed through the collecting section wherein the charged foreign particles are withdrawn from the air stream.

In particular, electrostatic air cleaning apparatus 10, shown in FIG. 1, includes a plurality of elongated ionizing wires 12. The ionizing wires are mounted adjacent the entrance to the air cleaning apparatus to provide a charge onto foreign particles entrained in an air stream as the air stream enters the air cleaning apparatus. Plates 16, disposed slightly upstream from the ionizing wires, are provided to establish electrostatic fields in combination with the ionizing wires.

The ionizing wires are suitably connected to a bus bar 18. Bus bar 18 is connected to a source of relatively large magnitude DC voltage represented by reference numeral 19. Typically, a power pack is provided which converts normal household AC voltage to a DC voltage of a substantial magnitude, for example in the range of 6,000 to 7,000 volts support member 21 is grounded as illustrated by reference numeral 23.

The air cleaning apparatus further includes a plurality of spaced apart plates 20 which define the collection section of the apparatus. A first set of alternate plates are connected to the DC power source through supply member 23. The remaining set of alternate plates are connected to ground via members 22. Members 22 are suitably connected to the housing of the apparatus to effectuate the grounding thereof. The alternately charged and grounded collecting plates 20 develop electrostatic fields whereby the charged foreign particles entrained in the air stream are deposited at the grounded collecting plates.

To insure proper operation, it is essential that ionizing wires 12 be maintained in parallel spaced relation to each other. In addition, the wires should be maintained taut. Sometimes, due to vibrations or other causes, an ionizing wire may break whereby it is necessary to replace such damaged wire. To minimize the inconvenience to the user resulting from a damaged ionizing wire, the mounting system for the ionizing wire should permit the user to replace the ionizing wire without necessitating a relatively expensive service call.

In order to achieve the foregoing, adjacent pairs of ionizing wires 12 are suitably connected to resilient spring members 26 shown in detail in FIG. 6. Spring members 26 include a body portion 28 having a pair of spaced apart resilient legs 30 extending outwardly therefrom. Each of legs 30 of spring member 26 terminate in ring-like portions 34. As shown in FIG. 6, each ring-like portion has a slight opening or slot 36 for readily permitting an ionizing wire 12 to be inserted into the ring-like opening for attachment to a spring member. In addition, by utilizing a curved surface as defined by ring-like portions 34, in lieu of a sharp, point-like surface, the generation of undesirable ozone is minimized. Generally, ozone is generated from point-like surfaces due to current streams.

As shown in FIGS. 1, 3 and 4, bus bar 18 has a plurality of slots 38 formed therein along its axial length. A spring member 26 is inserted into each of the slots. As illustrated in FIG. 6, legs 30 of spring members 26 are normally disposed at a slight angle to a line drawn perpendicular to body portion 28 of spring member 26. Ring-like portions 34 of legs 30 diverge from each other. Thus, when a spring member is inserted within one of the slots 38, the legs are forced inwardly towards each other by the contact force developed by the end walls of the slots. When spring member 26 is installed within slot 36, legs 34 are moved into a parallel position with respect to each other. The spring force thus established maintains intimate contact between bus bar 18 and legs 30. The high voltage supplied to the bus bar is thus transferred by legs 30 of spring members 26 to ionizing wires 12. In addition, the spring force prevents the spring members from accidentally falling from slots 38. However, when it is desired to remove the spring member from the slot for example when it is desired to replace an ionizing wire, the same may be readily accomplished by merely compressing legs 30 toward each other. The spring member 26 may thereafter be readily withdrawn from the slot 38.

For a reason to be more fully disclosed in co-pending application, Ser. No. 563,015, filed Mar. 28, 1975, preferably a second bus bar 42 is provided at the lower portion of apparatus 10. It should be understood that only one of the bus bars is actually connected to the source of voltage at any one time. Second bus bar 42 also has a plurality of axially extending slots 44 provided along its length. Slots 38 and 44 formed respectively in the first and second bus bars are in vertical alignment so that spring members 46, identical to spring members 26 hereinbefore described, may be mounted in slots 44 of second bus bar 42 to secure the other end of ionizing wires 12. Second spring members 46, in combination with first spring members 26 insure that ionizing wires 12 will be maintained parallel and taut for their entire length.

Preferably, as shown in FIG. 5, each end of the ionizing wires has a hollow tube 50 telescoped thereover. Tubes 50 function as terminals for the ionizing wires. Hollow tubes 50 have at least one deformed end 52 for permanently connecting the ionizing wires within the hollow tubes.

Figure 7:
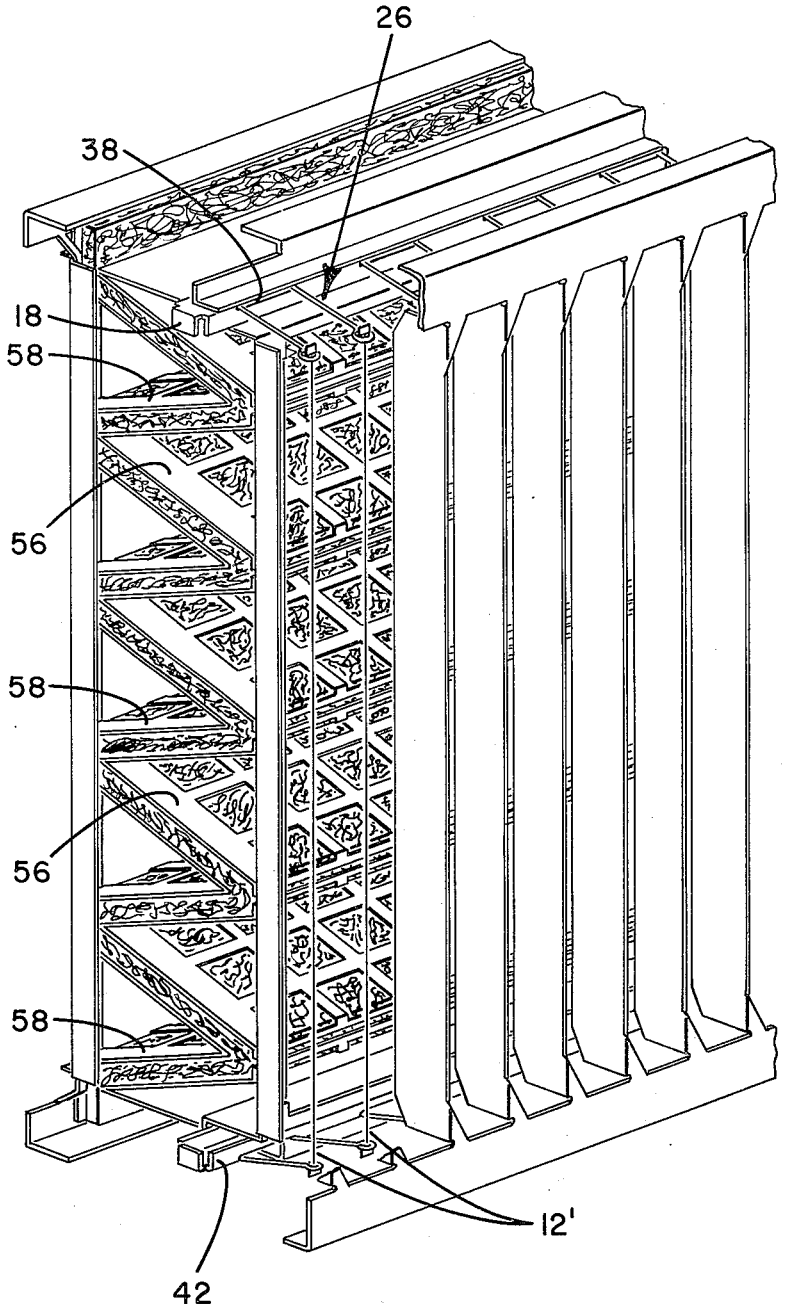
FIG. 7 is a perspective view of a second form of electrostatic apparatus in which the instant invention may be employed.

With particular reference to FIG. 7, there is disclosed an alternate form of electrostatic air cleaning apparatus. In particular, in lieu of collecting plates 20 shown in FIG. 1, the collector section of the apparatus illustrated in FIG. 7 includes a filter media formed from suitable foraminous material sandwiched between charged grid plates 56 and grounded grid plates 58. Foreign particles entrained within air streams passing through the air cleaning apparatus initially have charge applied at wires 12'. The grid plates 56 and 58 forming the outer and inner layers of the collector sandwich, form an electrostatic field whereby the charged foreign particles are attracted to the filter media provided between plates 56 and 58.

The mounting system employed for the ionizing wires of the air cleaning apparatus illustrated in FIG. 7, is identical to that heretofore described.

The mounting system in accordance with the present invention permits ionizing wires to be readily replaced. In addition, the mounting scheme maintains the ionizing wires under uniform tension. Furthermore, the present mounting scheme minimizes undesirable generation of ozone.

While preferred embodiments of the present invention have been described and illustrated, the invention should not be limited thereto, but may be otherwise embodied within the scope of the following claims.

I claim:

1. A mounting system for ionizing wires of electrostatic precipitation apparatus comprising:

a source of relatively large magnitude electrical voltage;

conductive bus bar means with a plurality of slots formed along the axial length thereof connected to said source of voltage;

a plurality of ionizing wires spaced axially along the length of said bus bar means and extending transversely thereto; and resilient electrically conductive spring means including a body portion and a pair of spaced apart resilient legs extending outwardly from said body portion and terminating in generally ring-like portions having the ends of a pair of adjacent ionizing wires secured therein and said body portions being disposed in said slots formed in said bus bar means and secured to the ends of each of said ionizing wires to maintain said ionizing wires under tension.

2. A mounting system in accordance with claim 1 wherein said resilient legs, when in a relaxed state are generally divergent with respect to each other, with said legs being forced into a generally parallel relation when said spring means is installed within said slots of said bus bar means.

3. A mounting system for ionizing wires of electrostatic precipitation apparatus comprising:

a source of relatively large magnitude electrical voltage;

a cell including a plurality of ionizing wires to provide a charge to foreign particles entrained in a gaseous stream flowing through said apparatus; and collecting means for removing the charged foreign particles from the gaseous stream;

a first electrically conductive bus bar secured to the top of said cell with a plurality of slots formed along the axial length thereof; and a second bus bar secured to the bottom of said cell with a plurality of slots formed along the axial length thereof and in vertical alignment with the slots formed in said first bus bar, with one of said bus bars being connected to said source of voltage; and individual electrically conductive resilient spring means disposed in each of said slots formed in the first and second bus bar to maintain said ionizing wires under tension, the ends of each of said ionizing wires being secured to a pair of vertically aligned spring means, wherein each of said spring means includes a body portion and a pair of resilient spaced apart legs extending outwardly from said body portion and terminating in a generally ring-like portion having the ends of a pair of adjacent ionizing wires disposed therein.

4. A mounting system in accordance with claim 3 wherein said resilient legs, when in a relaxed state are generally divergent with respect to each other, with said legs being forced into a generally parallel relation when said spring member is installed within said slots.

* * * * *